US007731187B2

(12) United States Patent
Horio et al.

(10) Patent No.: US 7,731,187 B2
(45) Date of Patent: Jun. 8, 2010

(54) SHEET MEDIUM ADJUSTMENT APPARATUS AND IMAGE FORMATION SYSTEM CAPABLE OF SORTING SHEET MEDIA

(75) Inventors: Toru Horio, Aichi-ken (JP); Minoru Hattori, Aichi-ken (JP); Shigeru Mizuno, Aichi-ken (JP); Ikumi Takashima, Aichi-ken (JP); Koji Furuta, Aichi-ken (JP); Masanobu Kimata, Aichi-ken (JP); Miyuki Ito, Aichi-ken (JP); Yoshihide Sugiyama, Aichi-ken (JP); Akihiro Tsuno, Aichi-ken (JP); Nakayama Naoya, Aichi-ken (JP); Ueno Shinichi, Aichi-ken (JP)

(73) Assignee: Ricoh Co., Ltd., Tokyo (JP)

( * ) Notice: Subject to any disclaimer, the term of this patent is extended or adjusted under 35 U.S.C. 154(b) by 585 days.

(21) Appl. No.: 11/699,405

(22) Filed: Jan. 30, 2007

(65) Prior Publication Data

US 2007/0176357 A1 Aug. 2, 2007

(30) Foreign Application Priority Data

Jan. 30, 2006 (JP) ..... 2006-020573

(51) Int. Cl.
*B65H 31/10* (2006.01)

(52) U.S. Cl. ..... 271/217; 221/214

(58) Field of Classification Search ..... 271/221, 271/217, 214

See application file for complete search history.

(56) References Cited

U.S. PATENT DOCUMENTS 6,527,269 B2 * 3/2003 Yamada et al. ..... 271/221
6,832,759 B2 * 12/2004 Nagasako et al. ..... 271/222
6,871,851 B2 * 3/2005 Tamura et al. ..... 271/221
6,889,974 B2 * 5/2005 Tamura et al. ..... 271/220
7,134,654 B2 11/2006 Yamada et al.
7,300,052 B2 * 11/2007 Tamura et al. ..... 271/221
7,451,980 B2 * 11/2008 Tamura et al. ..... 271/220
2004/0070141 A1 * 4/2004 Michels et al. ..... 271/220
2005/0189706 A1 * 9/2005 Tamura et al. ..... 271/221
2005/0225021 A1 10/2005 Yamada et al.

FOREIGN PATENT DOCUMENTS

JP 2002-293472 10/2002
JP 2002-356270 12/2002

* cited by examiner

*Primary Examiner*—Patrick Mackey
*Assistant Examiner*—Howard Sanders
(74) *Attorney, Agent, or Firm*—Harness, Dickey & Pierce, P.L.C.

(57) ABSTRACT

A sheet medium adjustment apparatus, e.g., in an image forming system, includes: an ejector to eject a conveyed sheet; a stacking device to stack each sheet ejected from the sheet ejector into a stack on a tray; a moving device to shift the stacking device in a movement direction perpendicular to a sheet-ejecting direction; a sheet aligning member to align ends of the sheets in the stack that are parallel to the sheet-ejecting direction; a stepping motor to move the sheet aligning member; and an evacuation device to evacuate the aligning member by an amount representing an evacuation displacement in the movement direction at a timing of aligning the sheet, the evacuation displacement being determined adaptively according to at least one of an attribute of a given sheet in the stack, an attribute of the stack as a whole and an attribute of the tray.

3 Claims, 10 Drawing Sheets

SHEET MEDIUM ADJUSTMENT APPARATUS AND IMAGE FORMATION SYSTEM CAPABLE OF SORTING SHEET MEDIA

PRIORITY STATEMENT

The present patent application claims priority under 35 U.S.C. §119 upon Japanese patent application No. 2006-020573, filed in the Japan Patent Office on Jan. 30, 2006, the content and disclosure of which is hereby incorporated by reference herein in its entirety.

BACKGROUND

Discussion of the Background

A background sheet medium adjustment apparatus may stack and/or adjust sheet media which is conveyed continually after an image formation process. After that, the background sheet medium adjustment apparatus may sort and/or eject sheet media. The background sheet medium adjustment apparatus may include a sheet-ejecting device, a stacking member or a tray, an aligning member, and/or a moving device. The sheet-ejecting device may eject sheets which are conveyed. The ejected sheets may be stacked on the tray. The aligning member may align sheets so that the sheet end sides which are parallel to a conveying direction may be trued up. The moving device may shift the tray or the aligning member by a given length in a direction which is perpendicular to the conveying direction. A background image formation apparatus may include the background sheet medium adjustment apparatus. A background post-processing apparatus for sheet media may include the background sheet medium adjustment apparatus.

For the adjustment, the aligning operation, the displacing operation, or the sorting operation may be carried out one by one when the sheet medium is stacked on the tray.

For example, the following three operations typically are performed during an interval of ejecting sheets: (1) a sheet returning operation to align sheets wherein the ejected sheets may be returned back against a fence using an inclination of the tray to align end sides of the sheets, (2) a sheet aligning operation with the aligning member to true up edges of the ejected sheets in the shifting direction, and (3) a shifting operation of the tray by a given length during pause time of ejecting sheets.

In operation (3), when the aligning member accepts next sheet at a time of tray shifting, it may cause interference between the tray and the aligning member. It is necessary to evacuate the aligning member to a direction perpendicular to an ejecting direction of the sheet media during shifting time of the tray after aligning the sheets.

When the sheet medium stacked on the tray is curled, an aligning member may be needed to carry out the aligning function. A background sheet medium adjustment apparatus may include an encoder on the rotating shaft of the aligning member so that an evacuation displacement of the aligning member may be arbitrarily changed according to the curl of the sheet.

Another background sheet medium adjustment apparatus may have a structure that an aligning member may move from a sheet aligning position into a main body to be contained and may move backward direction so that an operator may not be injured or the aligning member may not be broken at the time of picking out the sheet media.

SUMMARY

An embodiment of the present invention is directed to a sheet medium adjustment apparatus comprising: an ejector to eject a conveyed sheet of a printable medium; a stacking device to stack each sheet ejected from the sheet ejector into a stack on a tray; a moving device to shift the stacking device in a movement direction perpendicular to a sheet-ejecting direction; a sheet aligning member to align ends of the sheets in the stack that are parallel to the sheet-ejecting direction; a stepping motor to move the sheet aligning member; and an evacuation device to evacuate the aligning member by an amount representing an evacuation displacement in the movement direction by rotating the aligning member at a timing of aligning the sheet, the evacuation displacement being determined adaptively according to at least one of an attribute of a given sheet in the stack, an attribute of the stack as a whole and an attribute of the tray.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
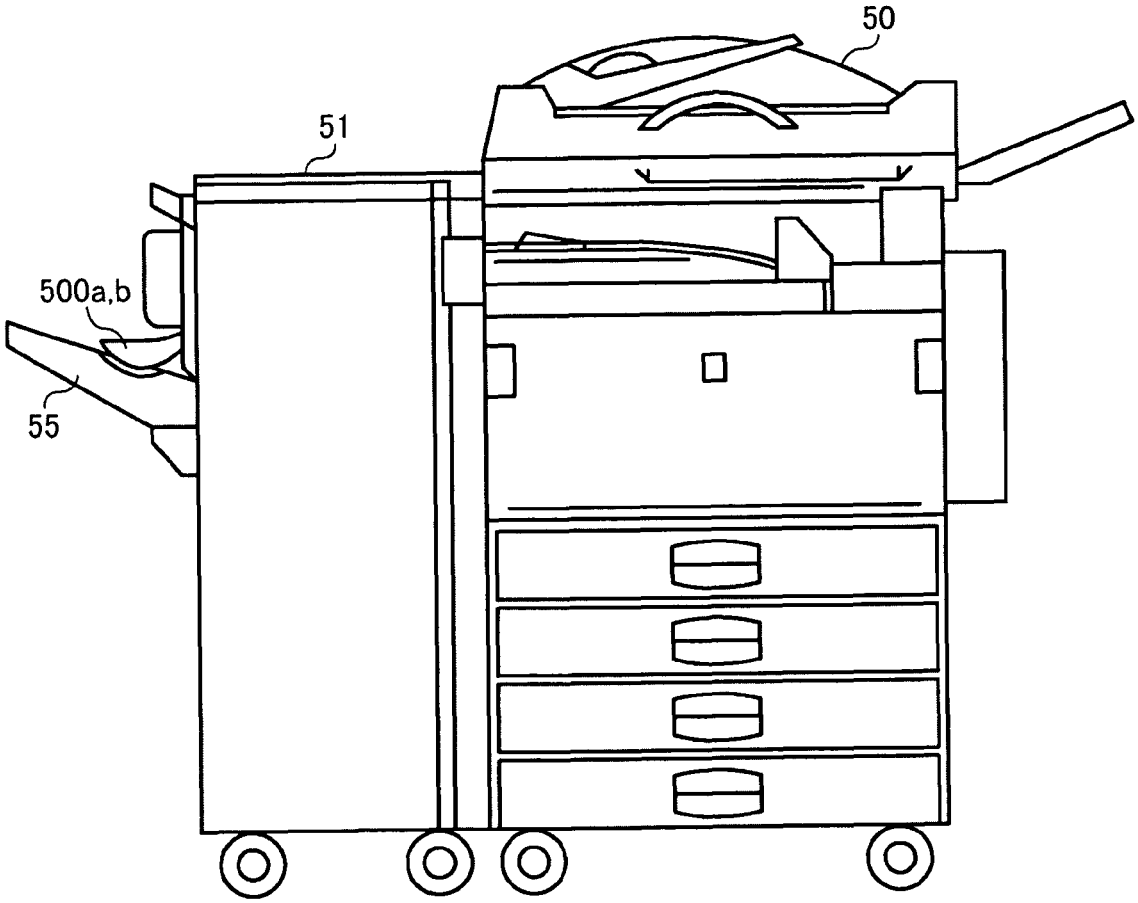
FIG. 1 is an elevational diagram (according to an example embodiment of the present invention) illustrating an image forming apparatus.

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 4, an example configuration of a sheet medium adjustment apparatus according to example embodiments is explained.

A term "sheet" represents a sheet of a medium on which an image can be formed or printed; for example, a sheet includes paper such as a carbon paper, a decalcomania paper, a recording paper, a partitioning paper, a computer form, a special paper, a cover, an OHP sheet, etc. Other printable media is available in sheets and their use here also is included.

Demands for post-processing capability vis-à-vis stacked sheets such as might be made by a copy contractor, for example, include a punch unit which makes punch holes for filing, a staple unit, a seal unit as a sheet medium post-processing apparatus for the paper discharged from an image forming apparatus, etc.

Figure 2:
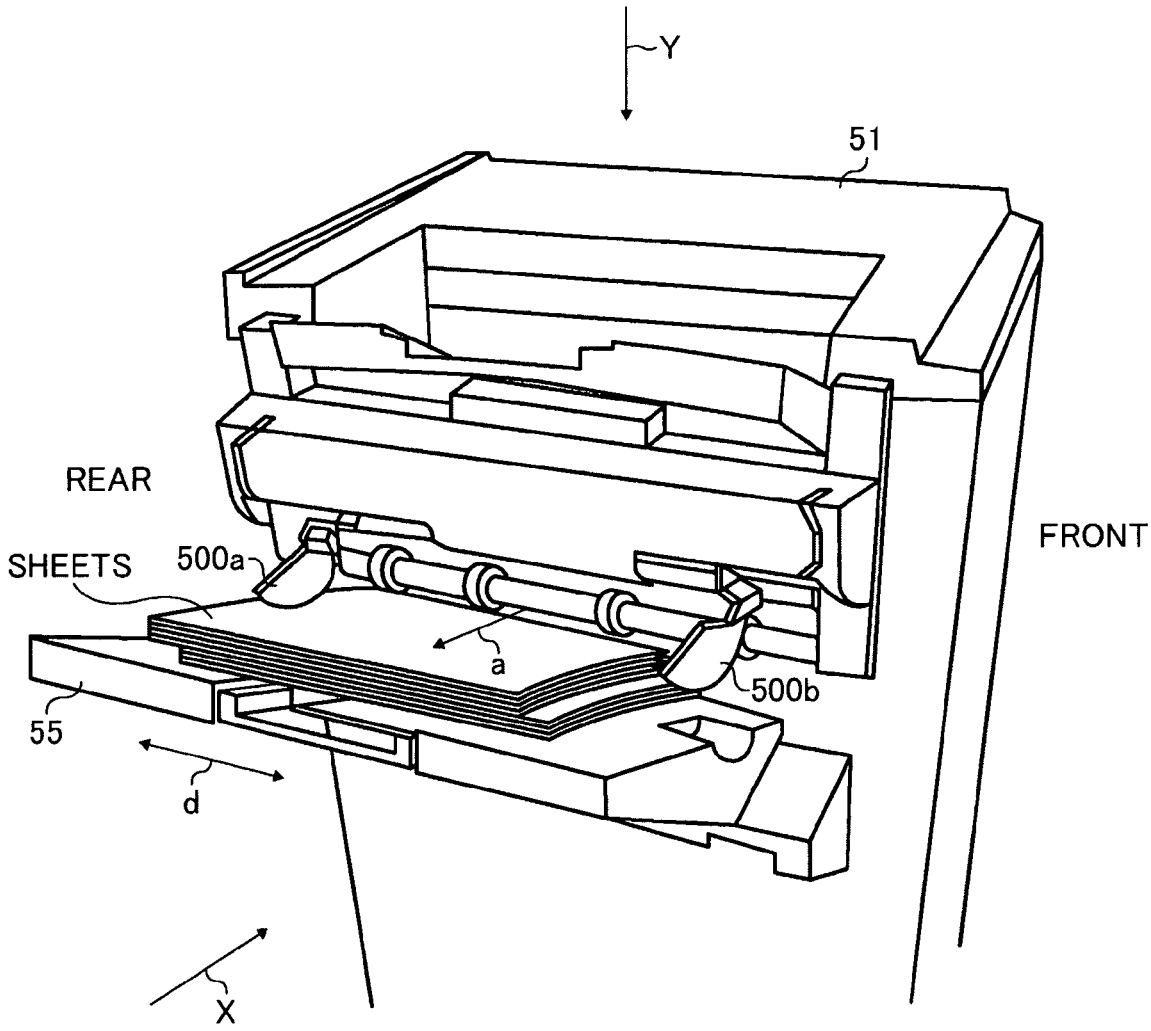
FIG. 2 is a perspective diagram (according to an example embodiment of the present invention) illustrating a sheet medium post-processing apparatus of the image forming apparatus of FIG. 1.
Figure 3:
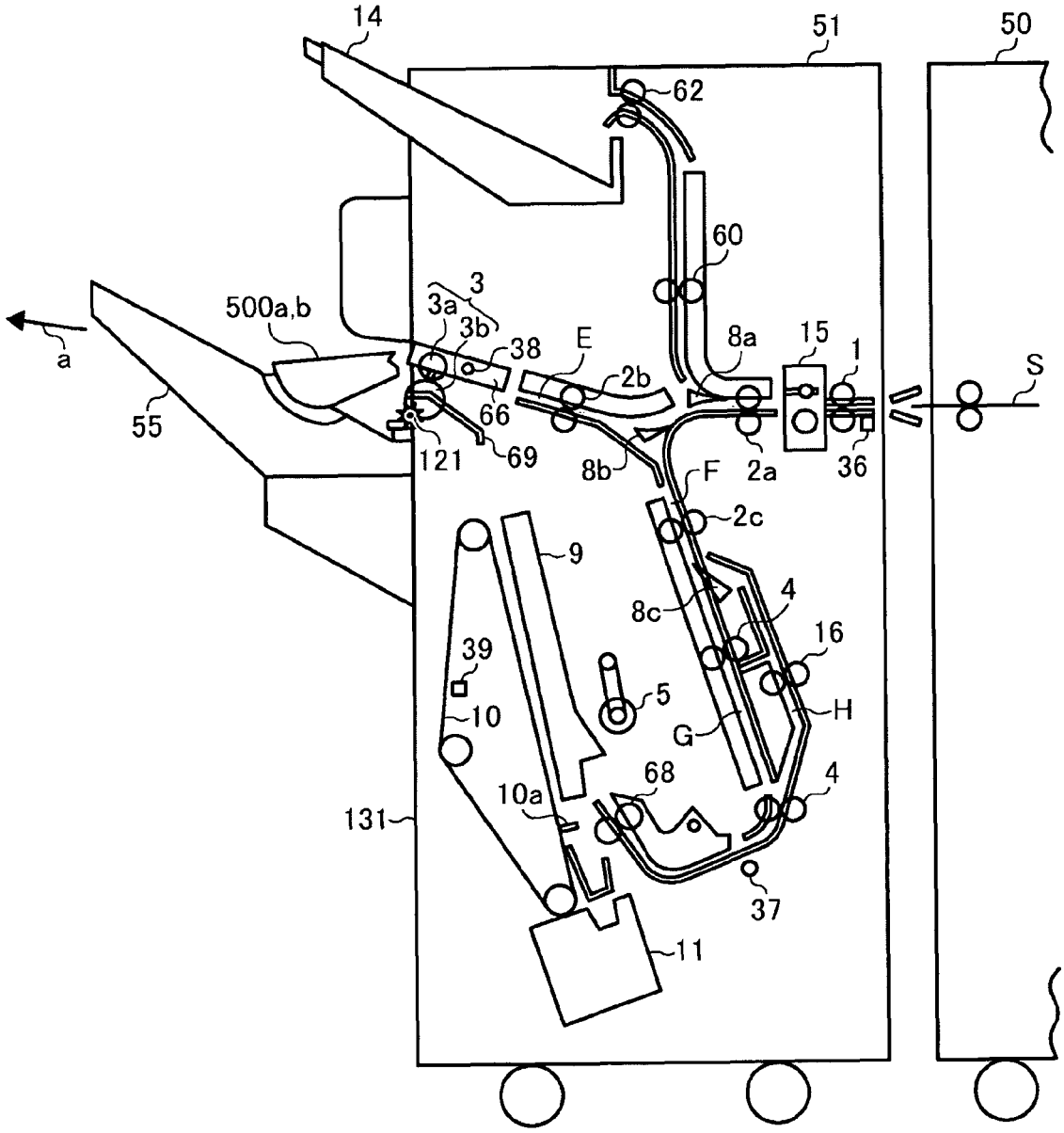
FIG. 3 is a cross-sectional diagram (according to an example embodiment of the present invention) illustrating a configuration of a sheet medium post-processing apparatus of the image forming apparatus of FIG. 1.
Figure 4:
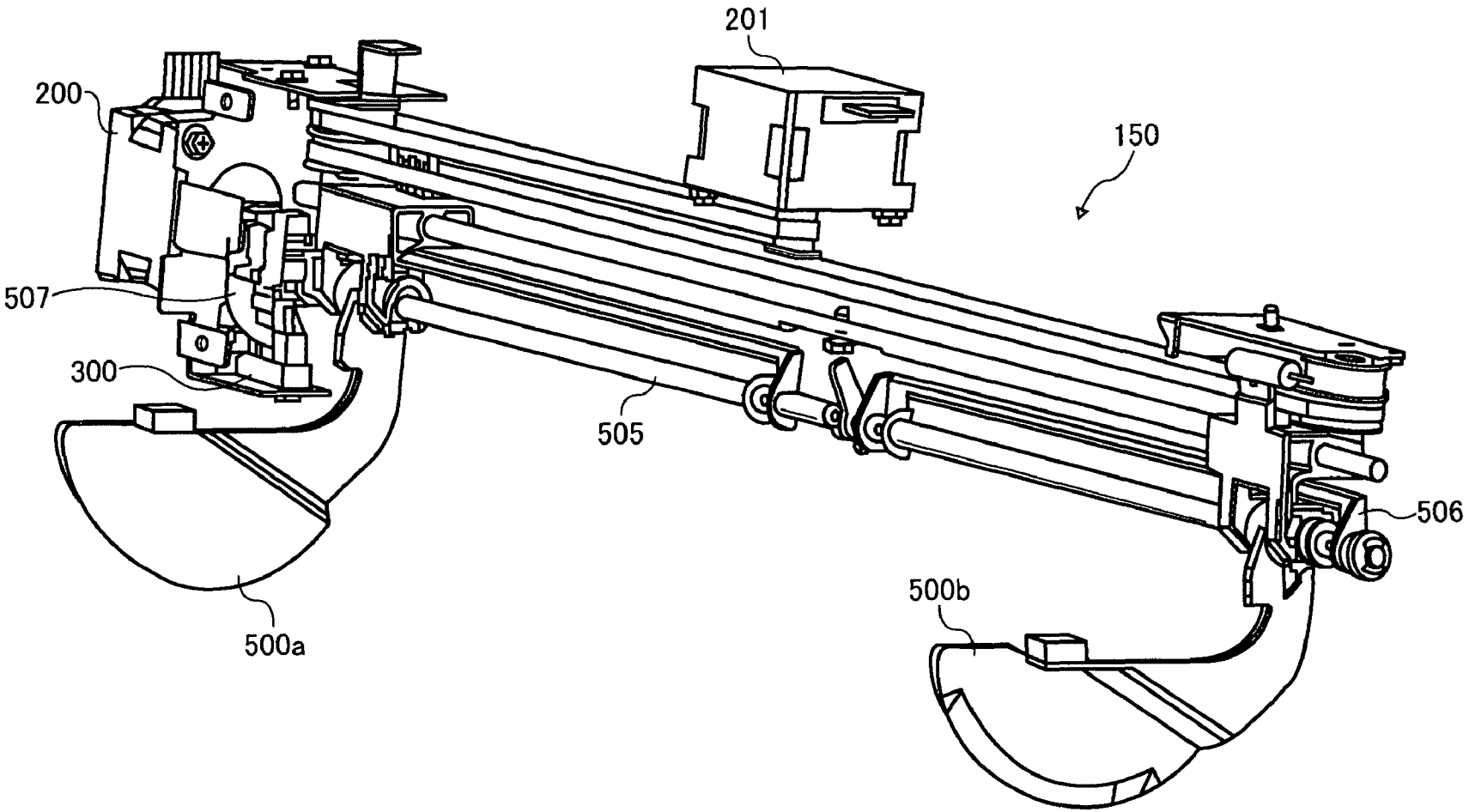
FIG. 4 is a perspective diagram (according to an example embodiment of the present invention) illustrating a sheet medium adjustment apparatus of the image forming apparatus of FIG. 1.

An example of a sheet medium adjustment apparatus which is configured with a sheet medium post-processing apparatus connected to an image forming apparatus that does not have a function of aligning sheets is explained. FIG. 1 is an example elevational diagram illustrating an image forming apparatus according to example embodiments. FIG. 2 is an example perspective diagram illustrating a sheet medium post-processing apparatus of the image forming apparatus of FIG. 1. FIG. 3 is an example cross-sectional diagram illustrating a configuration of a sheet medium post-processing apparatus of the image forming apparatus of FIG. 1. FIG. 4 is an example perspective diagram illustrating a sheet medium adjustment apparatus of the image forming apparatus of FIG. 1.

As shown in FIGS. 1 through 3, a sheet medium post-processing apparatus 51 which performs post-processing to the sheets may choose various post-processing modes from the operation screen (not shown) of an image forming apparatus 50. There is a sorting sheets mode for every bunch of sheets handled by the sheet medium post-processing apparatus 51. In the sorting mode, a processing is performed by directing sheet size and the number of sorting. An instruction related to the post-processing is transmitted to a controller (which includes a CPU) (see FIG. 7) of the image forming apparatus by key operation on an operation screen. The post-processing is performed with a signal transfer between the image forming apparatus 50, the sheet medium post-processing apparatus 51, and the controller.

In the sheet medium post-processing apparatus 51, the sheets with post-processing or without post-processing may be aligned on a tray by a sorting function and an aligning function of a sheet medium adjustment apparatus.

As shown in FIG. 3, the sheet medium post-processing apparatus 51 includes a sheet-ejecting device, which may be connected with the image forming apparatus 50 that does not have a function of aligning, may align the sheets on a tray 55. The sheet on which image formation was carried out in the image forming apparatus 50 reaches the sheet medium post-processing apparatus 51. The sheets may be aligned on the tray in an ejecting direction a by an adjustment operation of the sheet medium adjustment apparatus. In a sorting mode, e.g., the sheets may be stacked in position-shifted incremental units (there being a given number of sheets in a given incremental unit), each incremental unit being shifted relative to the preceding incremental unit in a shift direction d which intersects perpendicularly with the ejecting direction a as shown in FIG. 2. This sorting function is performed by a tray moving device which is not shown to move the tray 55 in the shift direction d.

As shown in FIG. 3, the sheet medium post-processing apparatus 51 includes the tray 55 which is capable of rising and falling as a device of loading sheets, and a proof (or document-that-was-copied) tray 14 as a fixed tray near the top of the sheet medium post-processing apparatus 51. An entrance sensor 36 and an entrance roller pair 1 are provided near a sheet transferring section of the image forming apparatus 50. The sheet fed with the entrance roller pair 1 may be conveyed to each conveyance course according to the post-processing mode.

A punch unit 15 which may make punch holes is provided in the lower stream of the entrance roller pair 1. A conveyance roller pair 2*a* is provided in the lower stream of the punch unit 15. A diverging member 8*a* is provided in the lower stream of the conveyance roller pair 2*a*. The sheet is guided alternatively to the conveyance course to the proof tray 14 or the conveyance course which is approximately horizontally adjacent (relative to FIG. 3) the diverging member 8*a*. When the sheet is conveyed towards the proof tray 14, a conveyance roller pair 60 may convey the sheet, and an ejecting sheet roller pair 62 may eject the sheet on the proof tray 14.

Another diverging member 8*b* is provided in the lower stream of the diverging member 8*a*. The sheet is alternatively guided to a non staple path E or a staple path F by this diverging member 8*b*. The divarication nails 8*a* and 8*b* may be shifted by an ON/OFF control of non-illustrated solenoid. The paper guided to the non staple path E may be conveyed by a conveyance roller pair 2*b*, and is discharged on the tray 55 by an ejecting roller 3 as an ejecting device. A return roller 121 which may return the sheet to a fence 131 for aligning sheet end is provided under the ejecting roller 3.

The ejecting roller 3 may include an upper roller 3*a* and a lower roller 3*b*. The lower roller 3*b* is provided and supported on a free end of a support member 66 that is rotatably provided and supported with its upstream portion in the sheet-ejecting direction a so that the lower roller 3*b* may rotate freely. The lower roller 3*b* may contact with the upper roller 3*a* by a gravity force or a pressing member. The sheet may discharge through between the lower roller 3*b* and the upper roller 3*a*. When a sheet bunch on which binding processing was carried out is discharged, the support member 66 may rotate to shift upward and it may be returned to in a given timing. This timing may be determined based on the detection signal of an ejecting sensor 38. The ejecting sensor 38 is provided at the upstream side of the ejecting roller 3.

The sheet guided to the staple path F is conveyed with a conveyance roller pair 2*c*. A diverging member 8*c* is provided in the lower stream of the conveyance roller pair 2*c*. The sheet may be alternatively guided to a staple path G or an evacuation path H by the diverging member 8*c*. The divarication nails 8*c* may be shifted by an ON/OFF control of non-illustrated solenoid.

The sheet passed through the staple path G further passes between a conveyance roller pair 4 and may be detected with an ejecting sheet sensor 37. Furthermore, the sheet may be stacked on a non-illustrated staple tray with a sheet-ejecting roller pair 68. In this case, a striking roller 5 adjusts for every sheet in the lengthwise direction (the sheet conveyance direction). An adjustment of a width direction (a sheet width direction which intersects perpendicularly with the ejecting direction a) is performed on a jogger fence 9. A stapler 11 may be driven with a staple signal from a controller (not illustrated in FIG. 3, but see FIG. 7) at interval between sheet bunches, so that a staple operation is performed. When the distance between the sheets discharged from the image forming apparatus 50 is short and the following sheet comes while carrying out binding processing, the following sheet may be guided to the evacuation path H and may be evacuated temporarily. The sheet guided into the evacuation path H may be conveyed with a conveyance roller pair 16.

The sheet bunch to which the binding processing was carried out may be conveyed to the ejecting roller 3 through a guide 69 with a discharge belt 10 which has a discharge nail 10*a*, and the sheet bunch may be ejected on the tray 55. A given position of the discharge nail 10*a* may be detected with a sensor 39.

The sheet medium post-processing apparatus 51 may perform a post processing as an original function. The sheet medium post-processing apparatus 51 may also align and sort the sheets stacked on the tray 55. Here, aligning should be understood as having two meanings, one is aligning the end of the sheets in the direction a, and the other is aligning the end of the sheets in the shift direction d. The former is performed with a return roller 121 which thrusts the sheets against an end fence 131. The latter is performed with a pair of aligning members 502*a* and 502*b* (see FIG. 2).

As shown in FIG. 3, the sheet medium adjustment apparatus mainly includes the tray 55 that stacks the ejected sheets, an elevator device for the tray 55, a positioning device to control the position in the rise-and-fall direction of the tray 55, a shifting tray device that moves perpendicularly with the sheet-ejecting direction a for sorting sheets, aligning members 500*a* and 500*b*, and a driver of the aligning members 500*a* and 500*b*. The sheet medium adjustment apparatus may align the sheets position so that the sheets are tucked between the aligning members 500*a* and 500*b*.

As shown in FIG. 3, the upper surface of the tray 55 inclines so that the height increases as the sheet moves toward ejecting direction a. The end fence 131 is vertically located at lower end of the tray 55. In FIG. 2, the sheet ejected from the ejecting roller 3 enters between the aligning members 500*a* and 500*b* that are standing by at the acceptance position. The sheets may slide on the tray 55 by gravity force or by the returning roller 121 if it is provided. Then the sheets may be aligned with the end of the sheets thrust against the end fence 131. The sheets with one end aligned may be further aligned in the shift direction d with operation of the aligning members 500*a* and 500*b*.

As shown in FIG. 4, the sheet medium adjustment apparatus 150 includes a stepping motor 201 which controls movement in a width direction, a stepping motor 200 which controls the up-and-down movement, a driving shaft 505 connected with the pulley of the stepping motor 200, a movable board 506 connected with the driving shaft, a filler 507 which shows the rotation state of the driving shaft 505, and a sensor 300 which detects the filler 507. The length between the aligning members 500*a* and 500*b* may be changed. The aligning members 500*a* and 500*b* may also be moved up and down. The state where the sensor 300 detects the filler 507 is a home position. The aligning members 500*a* and 500*b* are in a down state at the home position.

Figure 5:
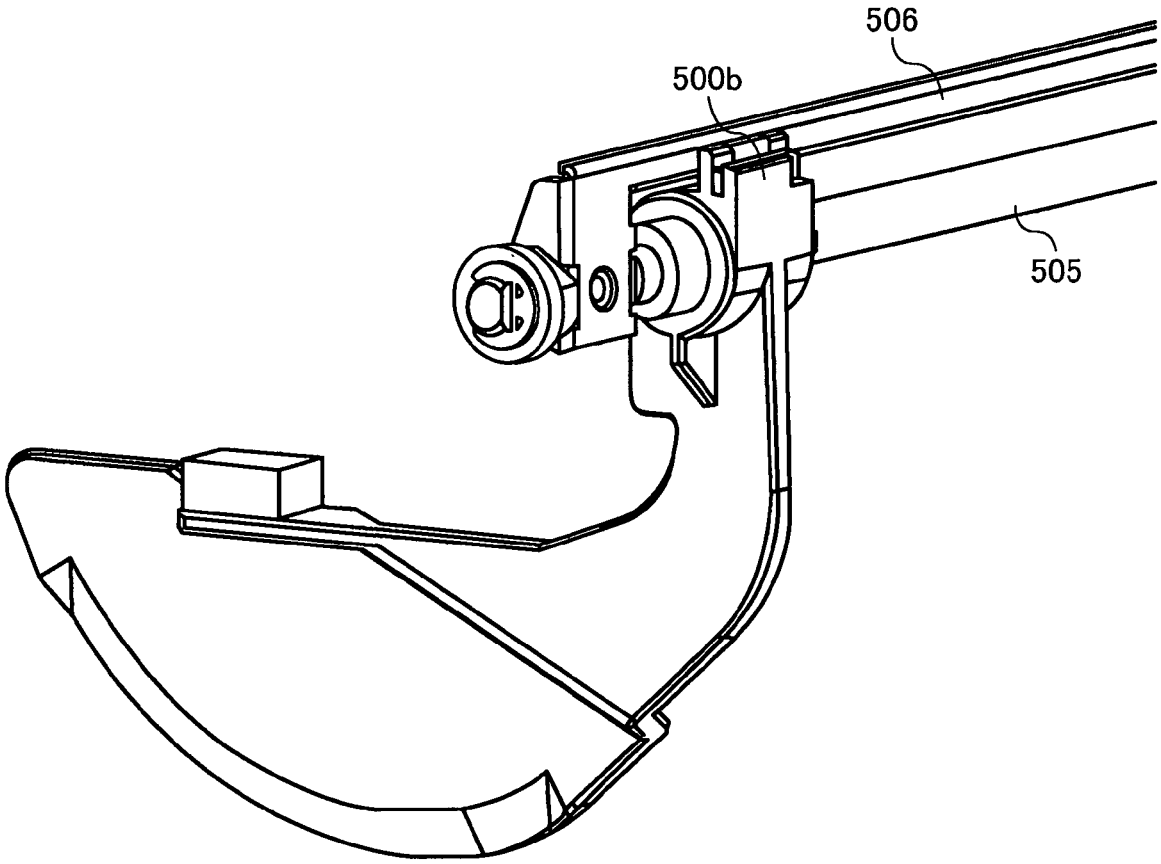
FIG. 5 is a perspective diagram (according to an example embodiment of the present invention) illustrating an aligning member of the image forming apparatus of FIG. 1.
Figure 6:
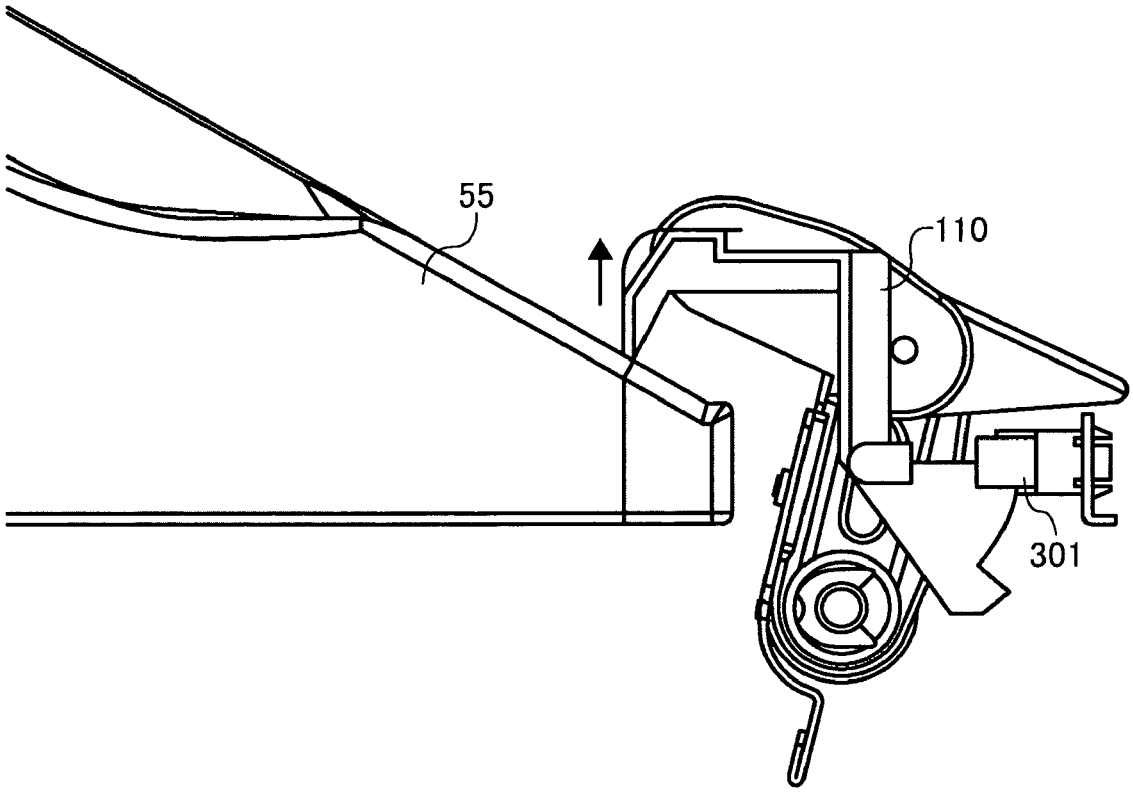
FIG. 6 is a cross-sectional diagram (according to an example embodiment of the present invention) illustrating a filler of the image forming apparatus of FIG. 1.
Figure 7:
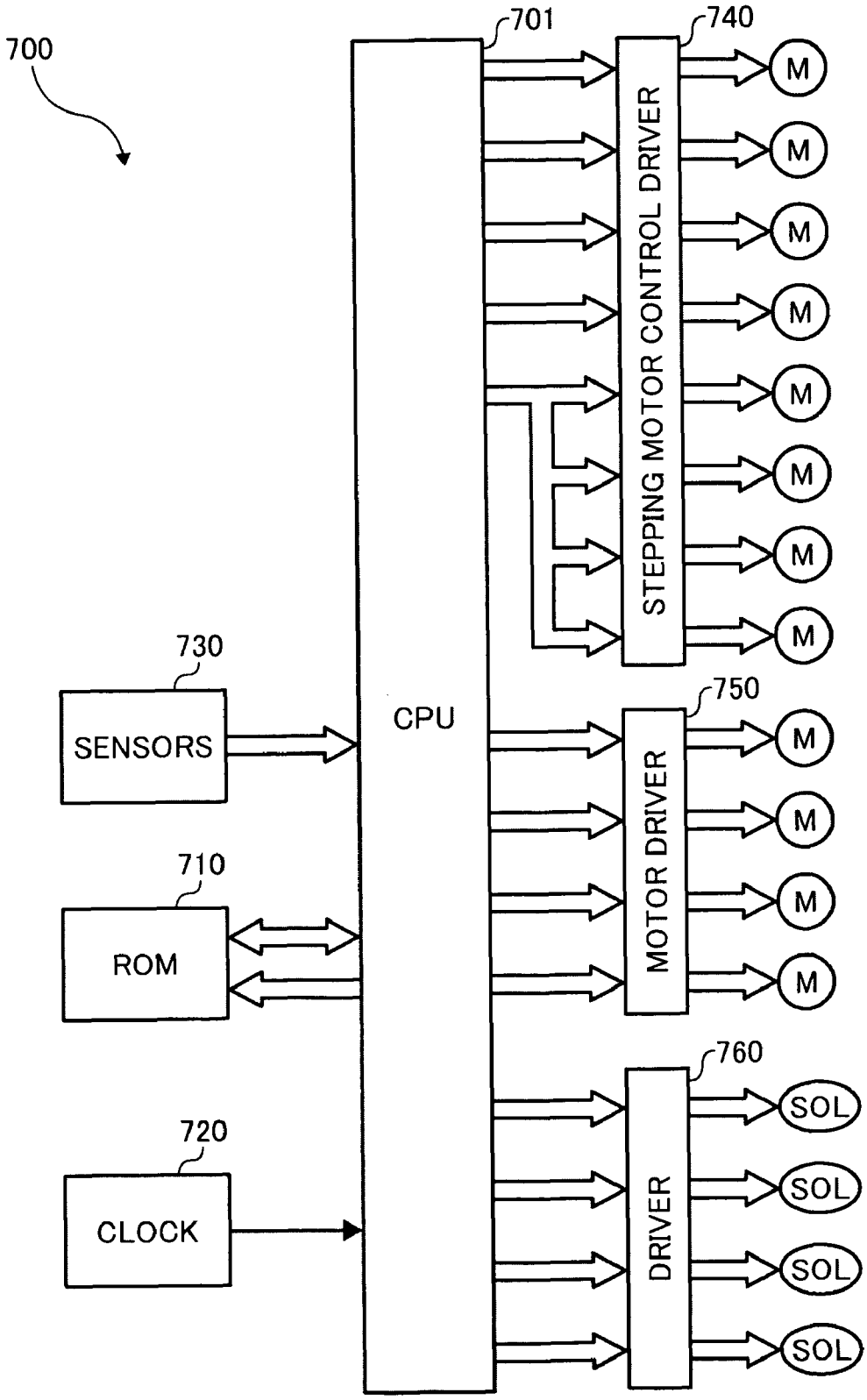
FIG. 7 is a block diagram of a controller (according to an example embodiment of the present invention) of the image forming apparatus of FIG. 1.
Figure 8A:
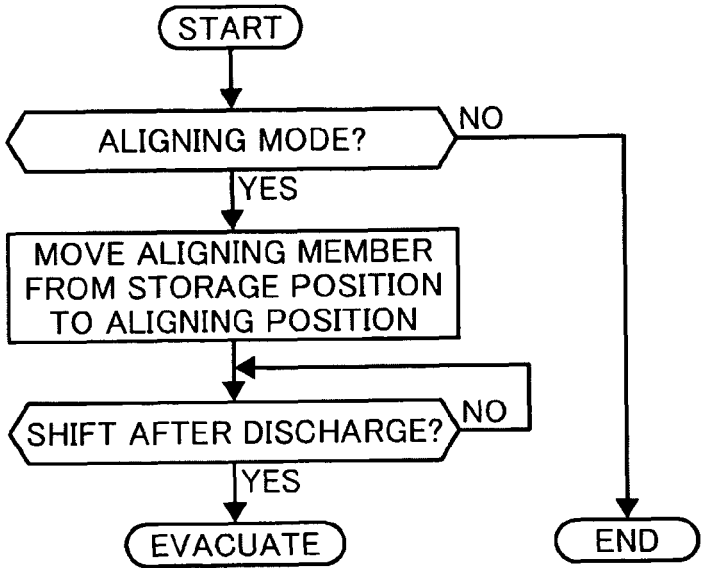
FIG. 8A is a flowchart (according to an example embodiment of the present invention) illustrating aligning control of the image forming apparatus of FIG. 1.
Figure 8B:
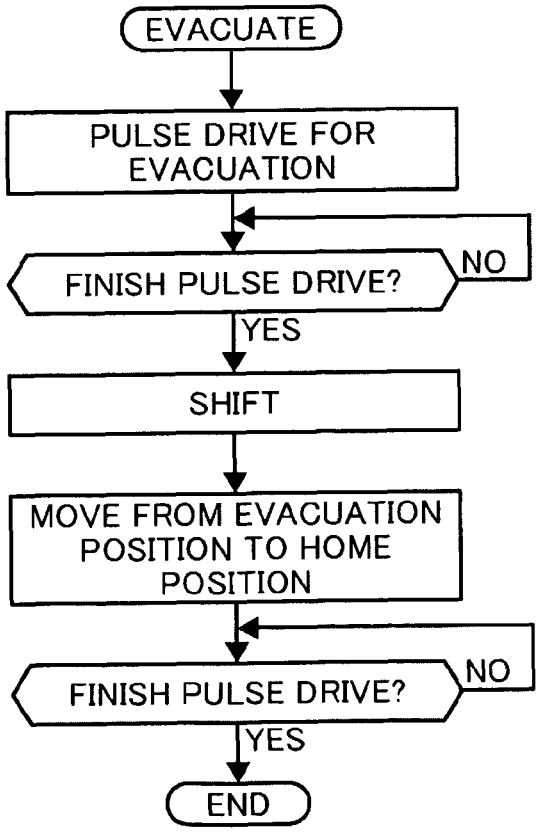
FIG. 8B is a flowchart (according to an example embodiment of the present invention) illustrating aligning control of the image forming apparatus of FIG. 1.
Figure 8C:
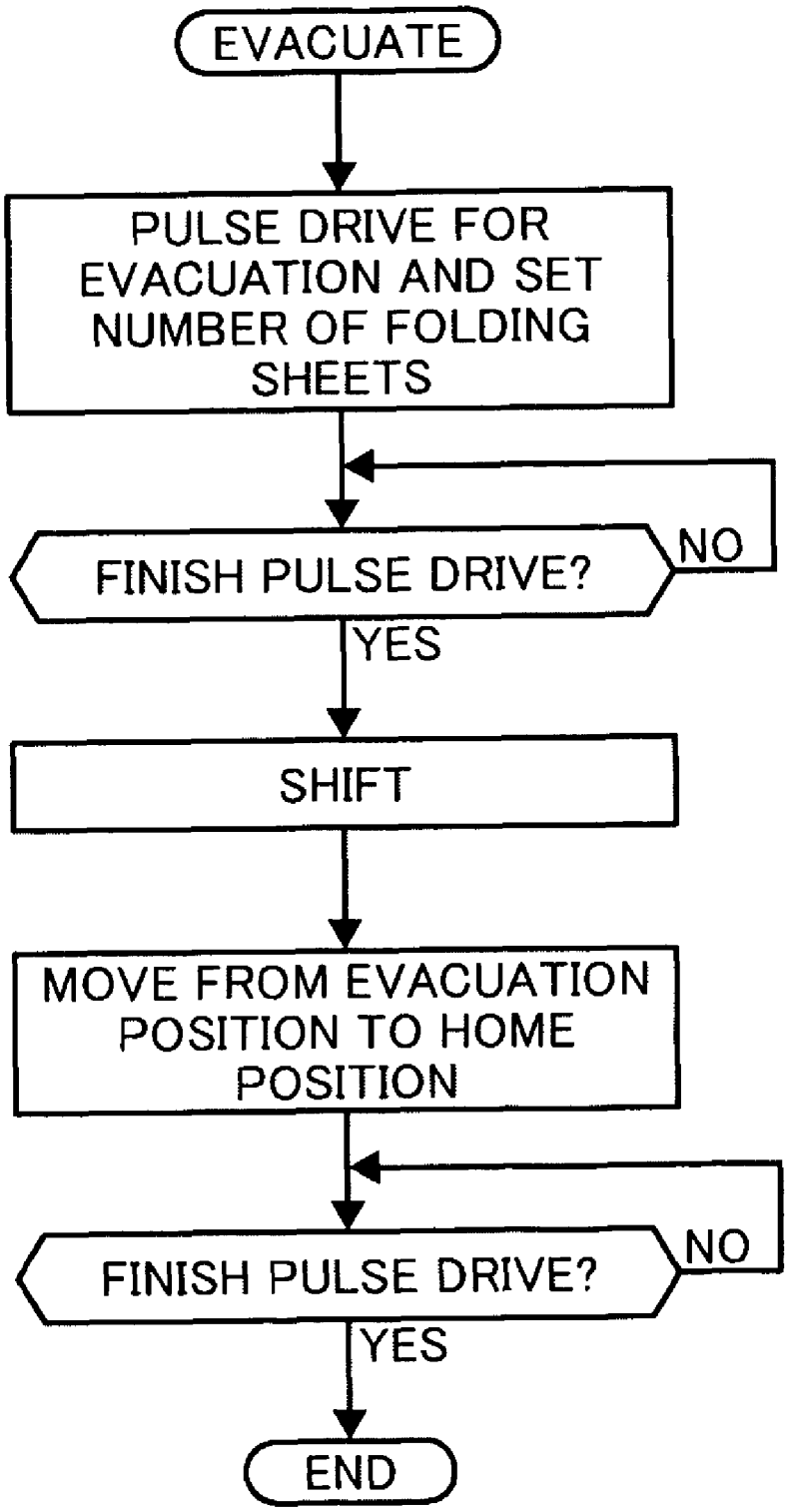
FIG. 8C is a flowchart (according to an example embodiment of the present invention) illustrating aligning control of the image forming apparatus of FIG. 1.
Figure 8D:
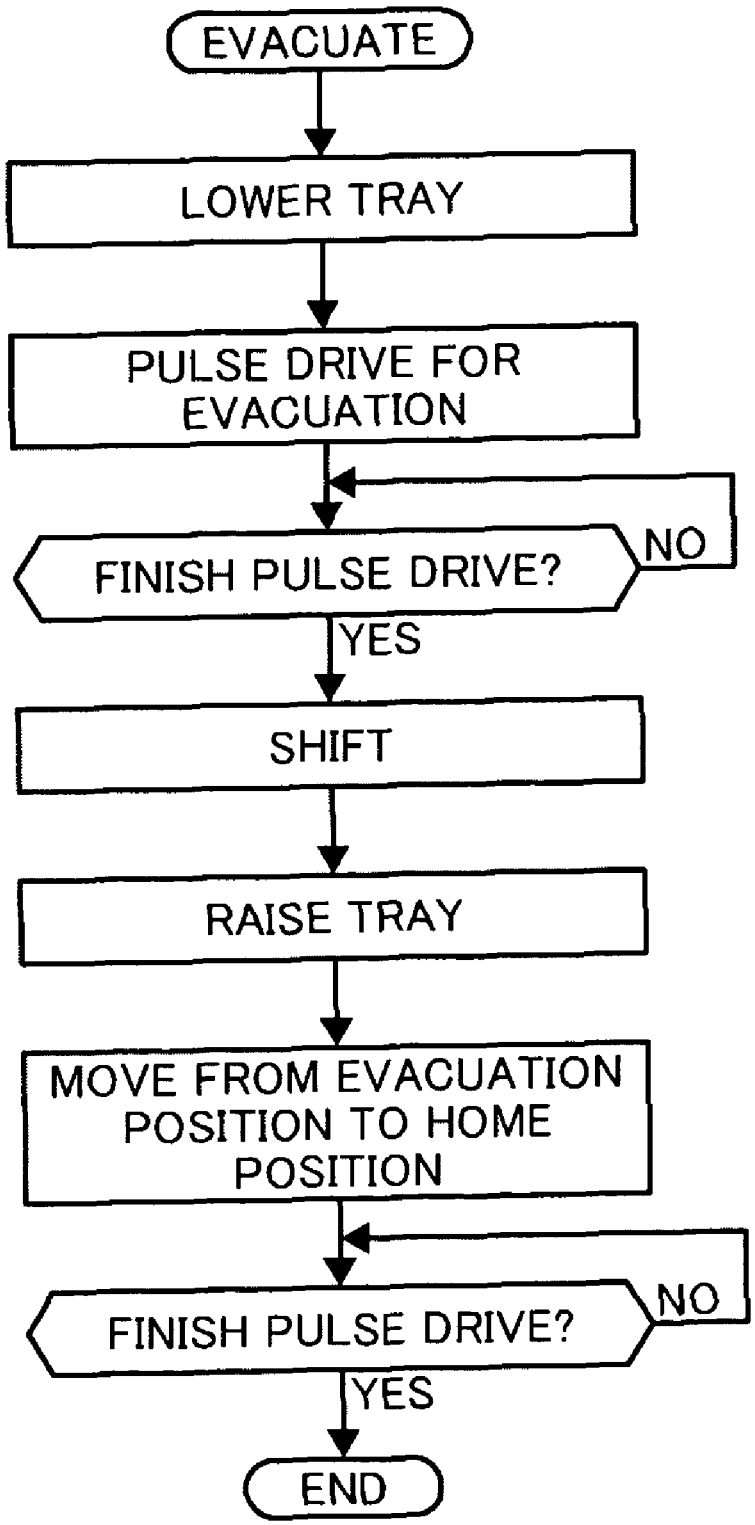
FIG. 8D is a flowchart (according to an example embodiment of the present invention) illustrating aligning control of the image forming apparatus of FIG. 1.

FIG. 5 is an example perspective diagram illustrating an aligning member of the image forming apparatus of FIG. 1. FIG. 6 is an example cross-sectional diagram illustrating a filler of the image forming apparatus of FIG. 1. FIG. 7 is an example block diagram of a controller 700 of the image forming apparatus of FIG. 1. As shown in FIG. 5, the sheet medium adjustment apparatus 150 may be constituted so that the movable board 506 may hold the roots of the aligning members 500*a* and 500*b*. The movable board 506 may limit downward movement of the aligning members 500*a* and 500*b* so that they are not lower than a given position. The movable board 506 does not limit upward movement of the aligning members 500*a* and 500*b*.

After ending discharge of a given number of sheets which constitutes the first sheet bunch discharged from the image forming apparatus 50, the sheet medium post-processing apparatus 51 may shift the tray 55 and stack the next sheet bunch. In such sorting, the aligning members 500*a* and 500*b* may move to an evacuation position. The tray 55 may shift when the aligning members 500*a* and 500*b* are in the evacuation position.

For example, when the aligning member 500*a* is a reference edge for aligning at sorting stage, the tray 55 may be in the state shifted to the aligning member 500*a* side. The aligning member 500*a* may be located at end edge position of discharged sheets on the tray 55, and may contact with a former bunch of the sheets. The aligning member 500*b* may locate out of edge of the bunch of the sheets on the tray 55 and at a home position in a vertical direction. FIG. 2 shows an opposite state of this. In every shift action of the tray 55, the driving shaft 505 may rotate and the aligning members 500*a* and 500*b* may be moved to the evacuation position by a downward pressing of the movable board 506. In every shift action of the tray 55, the opposite side aligning member may be on the former bunch of the sheets and the discharged bunch of sheets may be aligned.

An evacuation displacement of the aligning members 500*a* and 500*b* may be defined relative to the home position that the sensor 300 detects the filler 507, so that a rising distance of the aligning members 500*a* and 500*b* may be fixed. If the rising is the same or lower level of a top of the discharged bunch of sheets, the aligned sheets may be collapsed by interference with a shifted bunch of sheets.

If the rising distance is large enough to accept raised surface of sheet due to a curl or a fold of the sheet, a return time for accepting next sheet may be prolonged.

In this example, the evacuation displacement in consideration of a curl may be set as a default value. If a folding mode is chosen to discharge folding sheet, the evacuation displacement may be longer than the default value so that the interference between a bunch of sheets and the aligning members may be controlled at the shift operation.

For example, in order to control driving with a stepping motor, the number of drive steps may be variable, e.g., according to an attribute of the sheet. The time inside the controller may be measured and the rise time may be variable. For example, when the number of pulses (each pulse corresponding, e.g., to one displacement increment of the stepper motor) required to reach the top position of evacuation is 130 pulses (or, in other words, 130 is the maximum number of pulses), e.g., 120 pulses (or about 92.3% of the maximum number) for the evacuation of the usual (unfolded) discharge sheets and 125 pulses (or about 96.2% of the maximum number) for the evacuation of the discharge of folded sheets may be set by software. In this example, an evacuation displacement (in terms of a stepper motor pulse count) is adaptively set according to the attribute of whether the sheet is folded or unfolded attribute of the sheets.

The amount characterizing a raised surface of sheets differs between a plurality of folding sheets and one folding sheet. Then, there are differences in the amount of raised surface of sheets discharged when folding mode is selected. The image forming apparatus 50 may count the number of folding sheets. The evacuation displacement of the aligning members 500*a* and 500*b* may be variable depending on the number of folding sheets, so that this aligning control may realize a high productivity.

For example, as shown in FIG. 7, information of folding sheets in the image forming apparatus 50 may be transmitted to a central processing unit (CPU) 701 of the sheet medium post-processing apparatus 51. The CPU 701 may count an attribute of the stack, e.g., the number of folding sheets that constitute the stack. When, e.g., the number is fewer than 3, 120 pulses (or about 92.3% of the maximum number) to the stepping motor for the evacuation may be selected. When the number is 3 to 4, e.g., 125 pulses (or about 96.2% of the maximum number) may be selected. When the number is greater than 4, e.g., 130 pulses may be selected. Thus, the amount of evacuation may be variable.

The tray 55 may be moved downward by a given distance before shift operation. In this case, the evacuation displacement of the aligning members 500*a* and 500*b* may be shorter than that of the above-mentioned example because the tray 55 is in a lowered state.

A rising and falling control of the tray 55 is explained. The tray 55 provided in the sheet medium post-processing apparatus 51 may move up and down through a gear with a belt driven by a drive motor, which are not shown. As shown in FIG. 6, when the tray 55 is risen using a height detection sensor 301 provided near an outlet of the sheet medium post-processing apparatus 51, a height detection sensor 301 of a filler 110 for height detection may be in a detection state, so that the drive motor may be stopped. When a bunch of sheets are on the tray 55, a position of the tray 55 may be controlled so that a height relation between the discharged sheets and an accepting side may be held.

When the sheet is discharged from the sheet medium post-processing apparatus 51 as a timing of the shift, the aligning members 500*a* and 500*b* may be evacuated after the sheets is discharged completely, and the tray 55 may be moved down. If a falling distance of the tray 55 is 5 mm, the evacuation displacement may be 5 mm shorter than that of the above-mentioned first example.

In another example, the image forming apparatus 50 may count the number of folding sheets. The evacuation displacement of the aligning members 500*a* and 500*b* may be variable depending on the number of folding sheets, so that this aligning control may realize a high productivity. When the sheet is discharged from the sheet medium post-processing apparatus 51 as a timing of the shift, the aligning members 500*a* and 500*b* may be evacuated after the sheets is discharged completely, and the tray 55 may be moved down. For example, if a falling distance of the tray 55 is 5 mm, the evacuation displacement may be 5 mm shorter than that of the above-mentioned first example. An evacuation pulses for the distance of 5 mm to the stepping motor may be divided. For example, when the number of folding sheets is fewer than 3, e.g., 110 pulses or about 84.6% of the maximum number, assumed to be 130) to the stepping motor for the evacuation may be selected. When the number is 3 to 4, e.g., 115 pulses (or about 88.5% of the maximum number) may be selected. When the number is greater than 4, e.g., 120 pulses (or about 92.3% of the maximum number) may be selected. Thus, the amount of evacuation may be variable. In this example, an evacuation displacement (in terms of a stepper motor pulse count) is adaptively set according to the attribute of the falling distance of the tray 55.

The tray 55 may be moved downward by a given distance before shift operation. In this case, the evacuation of the aligning members 500*a* and 500*b* may not be performed. When the sheet is discharged from the sheet medium post-processing apparatus 51 as a timing of the shift, the aligning members 500*a* and 500*b* may be evacuated after the sheets is discharged completely, and the tray 55 may be moved down by a distance of 5 mm. After moving down of the tray 55, the shift operation may be started.

In a case of stacking a bunch of sheets as folding mode, the sensor 301 may detect the top sheet, so that the falling distance may be held and interference with the aligning members 500*a* and 500*b* may be controlled.

The tray 55 may move upward after the shift operation. When the height detection sensor 301 of the filler 110 for height detection is in a detection state, so that moving up may be stopped. In every shift action of the tray 55, the aligning member may be on the former bunch of the sheets and the discharged bunch of sheets may be aligned.

FIGS. 8A to 8D are example flowcharts illustrating aligning control of the image forming apparatus of FIG. 1. As shown in FIG. 7, the CPU 701 may receive a clock signal from a clock 720, and may control aligning as shown in FIG. 8 by communicating with the image forming apparatus 50. The CPU 701 also may receive signals from sensors 730, and may output signals to a stepping motor control driver 740, a motor driver 750, and a driver 760.

The sensors 730 are in the sheet medium post-processing apparatus 51 and the sheet medium adjustment apparatus 150. They may realize the various contents of detection in control in the flowcharts. The stepping motor control driver 740 may control the various stepping motors used for the sheet medium post-processing apparatus 51 and the sheet medium adjustment apparatus 150. The motor driver 750 may control various DC motors used for the sheet medium post-processing apparatus 51 and the sheet medium adjustment apparatus 150. The driver 760 may control various solenoids used for the sheet medium post-processing apparatus 51 and the sheet medium adjustment apparatus 150.

The present invention is not limited to the above-mentioned example embodiments. It is clear that the form of each above-mentioned example may be suitably changed within the limits of the present invention. Also, the number of components, a position, form, etc. is not limited to the form of each above-mentioned example, when carrying out the present invention, they may have a suitable number, a position, form, etc.

What is claimed is:

1. A method of operating a sheet medium adjustment apparatus, the method comprising:

ejecting a conveyed sheet of a printable medium;

stacking the ejected sheet into a stack on a tray;

shifting a stack that includes the stacked sheet in a movement direction perpendicular to a sheet-ejecting direction;

aligning, via an aligning member, ends of the sheets in the stack that are parallel to the sheet-ejecting direction;

evacuating the aligning member by an amount representing an evacuation displacement in the movement direction at a timing of aligning the sheet; and determining the evacuation displacement adaptively according to at least one of an attribute of a given sheet in the stack, an attribute of the stack as a whole and an attribute of the tray, wherein the evacuating displacement is determined as a percentage of a maximum evacuating displacement, wherein the attribute of the stack is the number of sheets in the stack, and when the number of sheets in the stack is fewer than 3, the evacuation displacement is set to a first percentage (P1) of the maximum evacuation displacement, when the number of sheets in the stack is between 3 and 4, the evacuation displacement is set to a second percentage (P2) of the maximum evacuation displacement, where P2>P1, and when the number of sheets in the stack exceeds 4, the evacuation displacement is set to the maximum evacuation displacement.

2. A method of operating a sheet medium adjustment apparatus, the method comprising:

ejecting a conveyed sheet of a printable medium;

stacking the ejected sheet into a stack on a tray;

shifting a stack that includes the stacked sheet in a movement direction perpendicular to a sheet-ejecting direction;

aligning, via an aligning member, ends of the sheets in the stack that are parallel to the sheet-ejecting direction;

evacuating the aligning member by an amount representing an evacuation displacement in the movement direction at a timing of aligning the sheet; and determining the evacuation displacement adaptively according to at least one of an attribute of a given sheet in the stack, an attribute of the stack as a whole and an attribute of the tray, wherein the evacuating displacement is determined as a percentage of a maximum evacuating displacement, wherein the attribute of the given sheet is whether the given sheet is folded or unfolded, and when the number of sheets in the stack is fewer than 3, the evacuation displacement is set to a first percentage (P1) of the maximum evacuation displacement, when the number of sheets in the stack is between 3 and 4, the evacuation displacement is set to a second percentage (P2) of the maximum evacuation displacement, where P2>P1, and when the number of sheets in the stack exceeds 4, the evacuation displacement is set to the maximum evacuation displacement.

3. A method of operating a sheet medium adjustment apparatus, the method comprising:

ejecting a conveyed sheet of a printable medium;

stacking the ejected sheet into a stack on a tray;

shifting a stack that includes the stacked sheet in a movement direction perpendicular to a sheet-ejecting direction;

aligning, via an aligning member, ends of the sheets in the stack that are parallel to the sheet-ejecting direction;

evacuating the aligning member by an amount representing an evacuation displacement in the movement direction at a timing of aligning the sheet; and determining the evacuation displacement adaptively according to at least one of an attribute of a given sheet in the stack, an attribute of the stack as a whole and an attribute of the tray, wherein the evacuating displacement is determined as a percentage of a maximum evacuating displacement, wherein the attribute of the tray is a falling distance thereof, and when the number of sheets in the stack is fewer than 3, the evacuation displacement is set to a first percentage (P1) of the maximum evacuation displacement, when the number of sheets in the stack is between 3 and 4, the evacuation displacement is set to a second percentage (P2) of the maximum evacuation displacement, where P2>P1, and when the number of sheets in the stack exceeds 4, the evacuation displacement is set to a third percentage (P3) of the maximum evacuation displacement, where P3>P2.

* * * * *